US006168216B1

(12) United States Patent
Nakajima et al.

(10) Patent No.: US 6,168,216 B1
(45) Date of Patent: Jan. 2, 2001

(54) VEHICLE DOOR LATCH DEVICE

(75) Inventors: Manabu Nakajima; Kazuhito Yokomori; Hiroshi Ishigaki, all of Yamanashi-ken (JP)

(73) Assignee: Mitsui Kinzoku Kogyo Kabushiki Kaisha, Tokyo (JP)

( * ) Notice: Under 35 U.S.C. 154(b), the term of this patent shall be extended for 0 days.

(21) Appl. No.: 09/221,161

(22) Filed: Dec. 28, 1998

(30) Foreign Application Priority Data

Dec. 25, 1997 (JP) ..... 9-367070
Jul. 7, 1998 (JP) ..... 10-207168
Jul. 14, 1998 (JP) ..... 10-214906

(51) Int. Cl.[7] ..... E05C 3/06

(52) U.S. Cl. ..... 292/201; 292/216; 292/225; 292/DIG. 23

(58) Field of Search ..... 292/201, DIG. 23, 292/216, 336.3, 214, 225, DIG. 2, 346, DIG. 38

(56) References Cited

U.S. PATENT DOCUMENTS 4,691,584 * 9/1987 Takaishi et al. ..... 74/471 R
4,851,742 * 7/1989 Chapman ..... 318/286
4,913,477 * 4/1990 Watanuki et al. ..... 292/216
5,181,754 1/1993 Shibata ..... 292/216
5,288,115 2/1994 Inoue et al. ..... 292/201
5,520,425 5/1996 Dowling ..... 292/201
5,564,761 10/1996 Mizuki et al. ..... 292/201
5,632,515 * 5/1997 Dowling ..... 292/216
5,722,706 * 3/1998 Bartel et al. ..... 292/216
5,732,988 * 3/1998 Mizuki ..... 292/201

* cited by examiner

*Primary Examiner*—Lynne H. Browne
*Assistant Examiner*—John B. Walsh
(74) *Attorney, Agent, or Firm*—Browdy and Neimark

(57) ABSTRACT

The present vehicle door latch device comprises a latch unit for keeping a door in a closed state, and a powered closing unit for supplying the power for fully closing the door, to the latch unit. A motor of the closing unit is connected to a wire lever of the latch unit through a power wire, and an opening lever of the latch unit is connected to a canceling lever of the closing unit through a safety wire. The latch unit has a one-motion door opening mechanism. An inner lever connected to an inside opening handle is engageable with the opening lever. A switch which detects the rotational position of a latch of the latch unit is arranged in such a position as not to be overlapped onto the wire lever.

10 Claims, 14 Drawing Sheets

7
109
58
66
30
31
37
30A
13
22
38
26
43
47
30A
30
44
39
45
27
33
28
42
29
31
10
75
11

FIG. 16
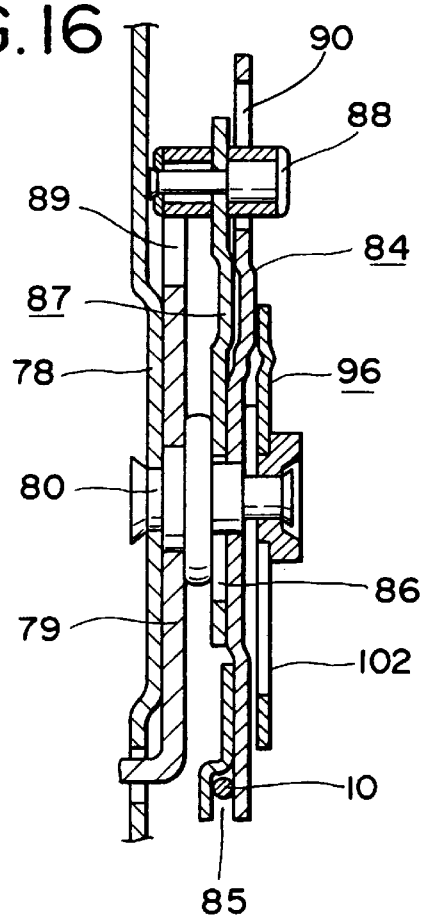
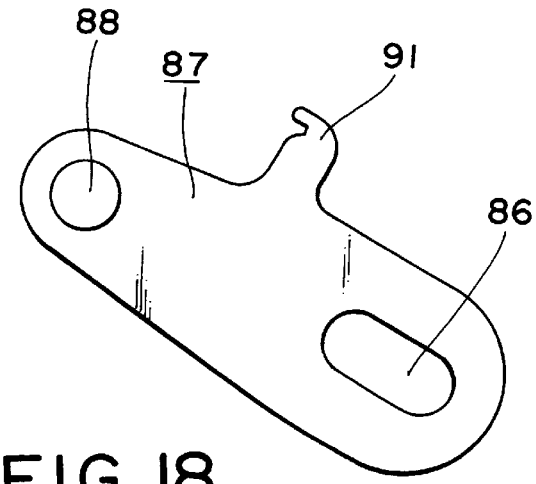
FIG. 18
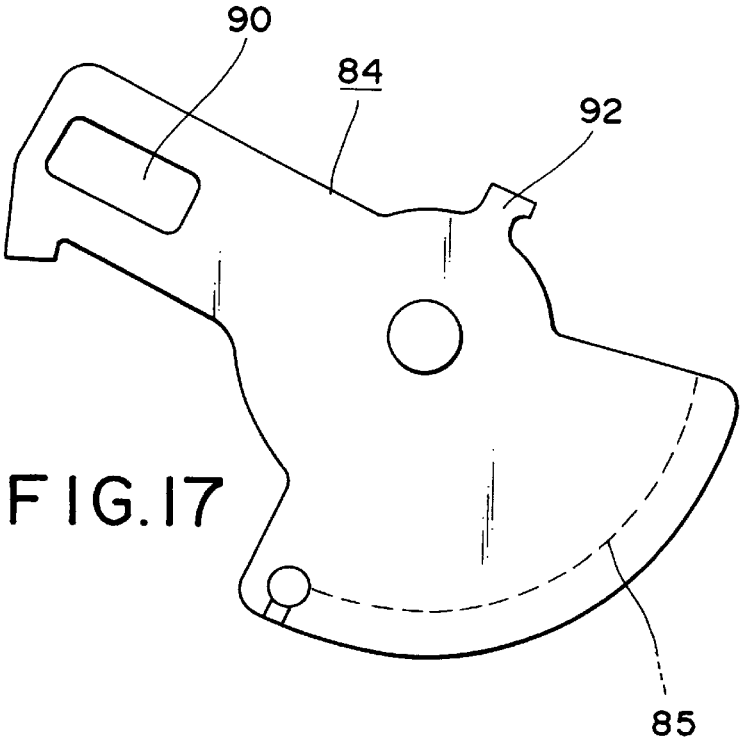
FIG. 17

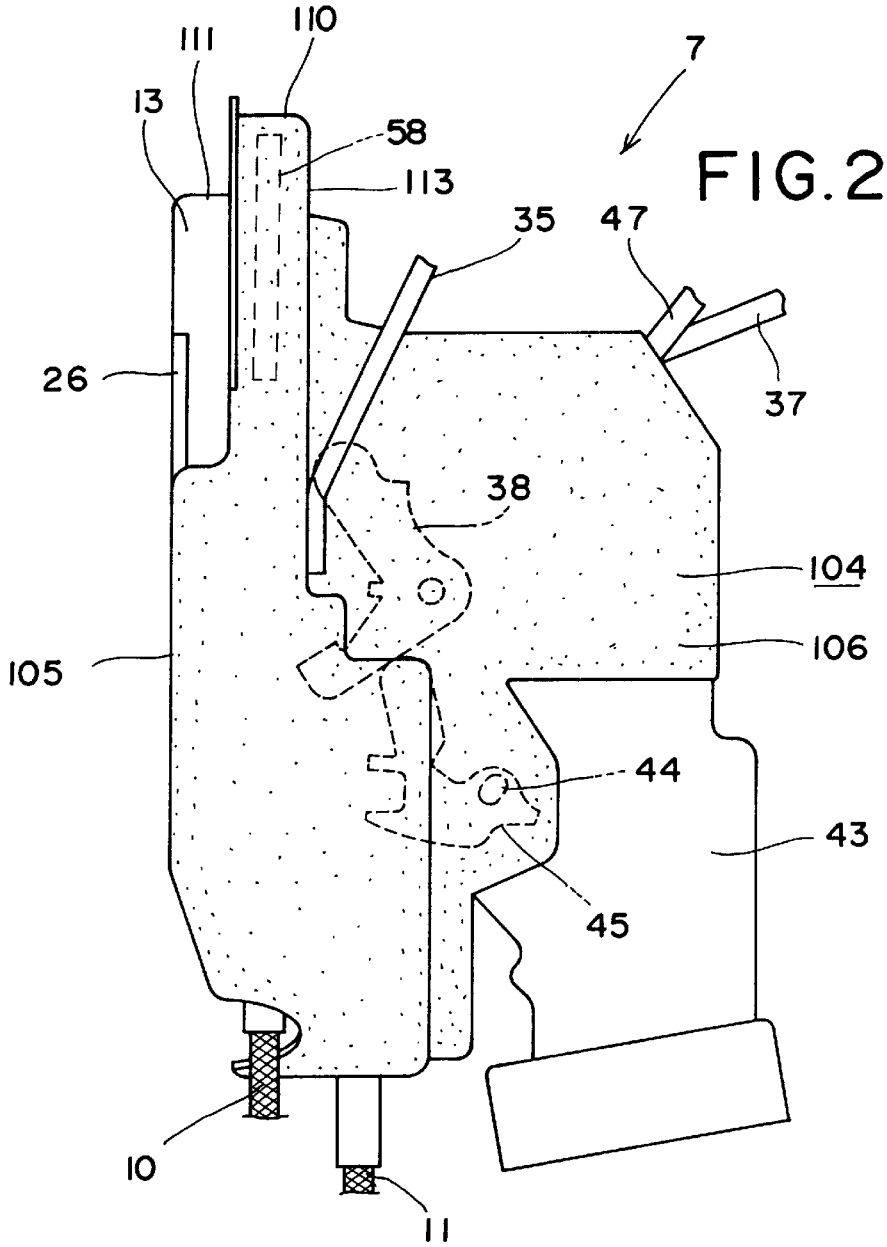
FIG. 20
FIG. 21
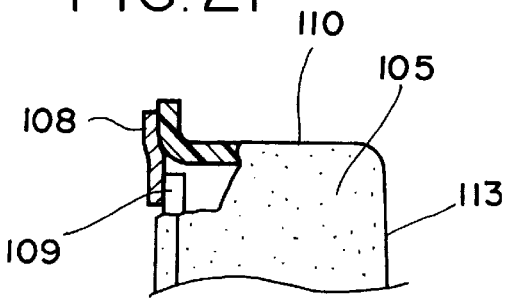
FIG. 22
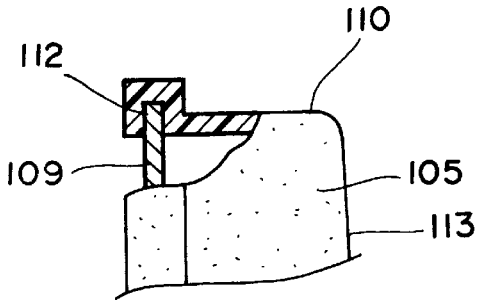

VEHICLE DOOR LATCH DEVICE

FIELD OF THE INVENTION

The present invention relates to a vehicle door latch device, and more specifically relates to a door latch device suitable for a door which is swingably hinged to a vehicle body.

BACKGROUND OF THE INVENTION

U.S. Pat. No. 5,520,425 describes a vehicle door latch device comprising a latch unit which keeps a door in a door-closed state, and a powered closing unit which supplies the power for fully closing the door to the latch unit. The latch unit comprises a latch which is rotatable from an unlatched position through a half-latched position to a full-latched position by an engagement with a striker fixed to the vehicle body, and an opening lever which is connected to an opening handle of the door and releases the engagement between the latch and the striker. The powered closing unit comprises a motor, a winch lever which is operatively connected to the latch through a flexible power wire and is turned by the motor, and a safety mechanism which can release the connection between the winch lever and the motor. The safety mechanism is connected to the opening lever through a rod.

As a problem to be solved of the prior art device, there is such a problem that since the safety mechanism and the opening lever are connected by a safety rod, the assembly is troublesome and the degree of freedom in the installation position of the powered closing unit is small. Furthermore, since the safety rod and the power wire which are extending from the powered closing unit are respectively extending in different directions, the assembly of the latch device is further troublesome.

Furthermore, previously, a door latch unit having a "one-motion door opening mechanism" by which an opening operation of an inside opening handle of the door simultaneously performs the opening of the door and the returning to the unlocked state of the lock mechanism when the lock mechanism is in the locked state, has been well known. For example, U.S. Pat. No. 5,181,754 discloses a door latch unit which comprises a latch rotatable from an unlatched position through a half-latched position to a full-latched position by an engagement with a striker fastened to the vehicle body, a ratchet preventing the latch from returning from the half-latched position or the full-latched to the unlatched position by the engagement with the latch, an opening lever connected to an outside opening handle of the vehicle door, a lock mechanism having an unlocked state where the rotation of the opening lever is transmitted to the ratchet and a locked state where the rotation of the opening lever is not transmitted to the ratchet, and an inner lever connected to an inside opening handle of the vehicle door. The inner lever can come into contact with the ratchet so that a rotation of the inner lever can be transmitted to the ratchet without through the lock mechanism. The lock mechanism is arranged so as to be restored to the unlocked state when the inner lever is turned while the lock mechanism is in the locked state.

If the powered closing unit proposed by U.S. Pat. No. 5,520,425 is relevantly is used in the latch unit with the one-motion door opening mechanism, this causes such a problem that the safety mechanism for interrupting the operation of the powered closing unit is actuated by the opening operation of the outside opening handle but is not actuated by the inside opening handle. Because the opening lever of the latch unit provided with the one-motion door opening mechanism is rotated by the opening operation of the outside opening handle but is not rotated by the opening operation of the inside opening handle.

Furthermore, U.S. Pat. No. 5,288,115 discloses a door latch unit which comprises a latch body fixed to a rear end portion of the door and having a recess on a front side thereof, a latch rotatably contained in the recess with a latch shaft having a shaft center in a given direction and rotatable from an unlatched position through a half-latched position to a full-latched position by an engagement with a striker fixed to a vehicle body, a latch spring urging the latch from the full-latched position toward the unlatched position, a ratchet rotatably contained in the recess with a ratchet shaft in parallel with the latch shaft and preventing the latch from returning from the half-latched position or the full-latched position to the unlatched position by an engagement with the latch, a switch attached to the latch body for detecting a rotational position of the latch, a wire lever rotatably attached to the latch body with a wire shaft in parallel with the latch shaft and causing the latch to turn from the half-latched position to the full-latched position when rotated, a return spring urging the wire lever toward an initial position.

Generally, it is a proposition in a latch unit to reduce a thickness of an upper portion of the latch unit in a front-and-rear direction thereof. The large thickness in the front-and-rear direction of the latch unit causes problems that the weight of the unit is naturally increased and that the latch unit is easily apt to interfere with the glass rail which slidably holds both sides of a window glass of the door, and therefore the degree of freedom in the total design of the door is lowered. On this point, it would be said that the latch unit described in U.S. Pat. No. 5,288,115 effectively uses the thickness of the latch body since the wire lever is arranged in the recess of the latch body, but on the other hand, the vertical length of the latch body is made to be longer in order to contain the wire lever in the recess. The long latch body is apt to interfere with the inclined glass rail (refer to FIG. 13), and the weight also becomes heavier. In addition, it can also be pointed out that in this conventional latch unit, the thickness in the front-and-rear direction of the latch body itself is thick. That is, a bottom wall of the recess of the latch body is thicker than that required for the latch body in strength. This is caused since the bottom wall has a space or a groove, for containing a latch springs, which is formed by using the thickness. The thickness actually required in strength is the rest subtracted the thickness corresponding to the groove from the thickness of the unit.

On the other hand, U.S. Pat. No. 5,564,761 discloses a latch unit in which the wire lever is arranged on the rear side of the latch body. This conventional latch unit has a thick bottom wall of the latch body similarly to the latch unit described in U.S. Pat. No. 5,288,115.

SUMMARY OF THE INVENTION

Therefore, an object of the present invention is to provide a vehicle door latch device in which a connection between a latch unit and a powered closing unit is easy.

Furthermore, another object of the present invention is to provide a door latch device with a one-motion door opening mechanism in which a safety mechanism of the powered closing unit can be actuated by an inside opening handle of the door.

Furthermore, another object of the present invention is to provide a vehicle door latch device having a latch unit in which thickness of an upper portion thereof is reduced.

A still another object, feature, and advantage of the present invention are clarified by understanding the following detailed description by referring to the appended drawings.

BRIEF DESCRIPTION OF THE DRAWINGS

FIG. 16 is a cross sectional view of the powered closing unit;

FIG. 17 is a front view of a winch lever of the powered closing unit;

FIG. 18 is a front view of a connecting member of the powered closing unit;

FIG. 20 is a view showing an exterior side of the latch unit with the antitheft protector; and FIG. 21 and FIG. 22 are partial enlarged view of the antitheft protector and a latch body of the latch unit.

DESCRIPTION OF THE PREFERRED EMBODIMENT

Figure 1:
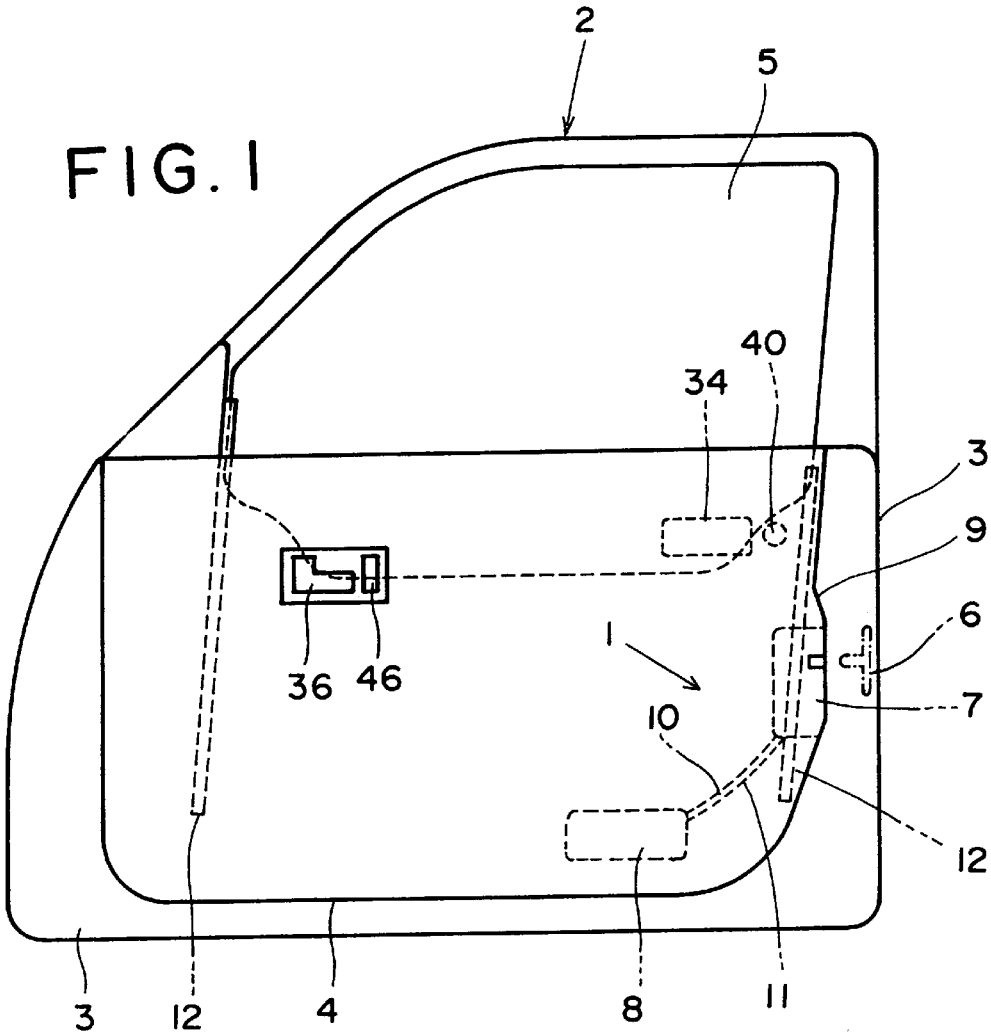
FIG. 1 is a view showing an interior side of a swing-type vehicle door with a door latch device in accordance with an embodiment of the present invention.
Figure 2:
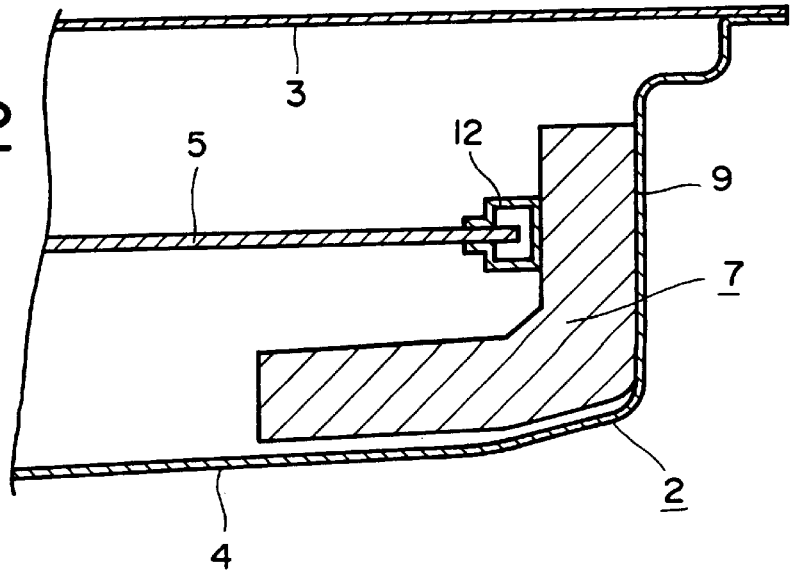
FIG. 2 is a cross sectional view of the door showing the relation between a latch unit of the door latch device and a glass rail.

FIG. 1 shows an interior side of a typical swing-type vehicle door 2 provided with a door latch device 1 according to an embodiment of the present invention. The door 2 is roughly comprised of a metal outer panel 3, a metal inner panel 4, and a window glass 5. The latch device 1 comprises a latch unit 7 for holding the door 2 in a door-closed state in cooperation with a striker 6 fixed to the vehicle body (not shown), and a powered closing unit 8 for supplying a power to the latch unit 7 for causing the latch unit to move the door 2 toward a full-closed or full-latched position. As shown in FIG. 2, the latch unit 7 is fixed to a metal rear panel 9 bridged between a rear edge of the outer panel 3 and a rear edge of the inner panel 4, with a bolt (not shown).

Between the latch unit 7 and the closing unit 8, a flexible power wire 10 is provided to transmit a mechanical power from the closing unit 8 to the latch unit 7. Further, between the latch unit 7 and the closing unit 8, a flexible safety wire 11 is provided to transmit a door-opening operational force from the latch unit 7 to the closing unit 8. Two wires 10, 11 are arranged approximately in parallel with each other. The powered closing unit 8, as described later in detail, operates to pull the power wire 10 when the door 2 is moved by a manual power to a half-latched position from a door-open position so as to be initially closed, and thereby the latch unit 7 displaces the door 2 from the half-latched position to the full-latched position. 12 is a glass rail which slidably supports both side edges of the window glass 5.

Figure 3:
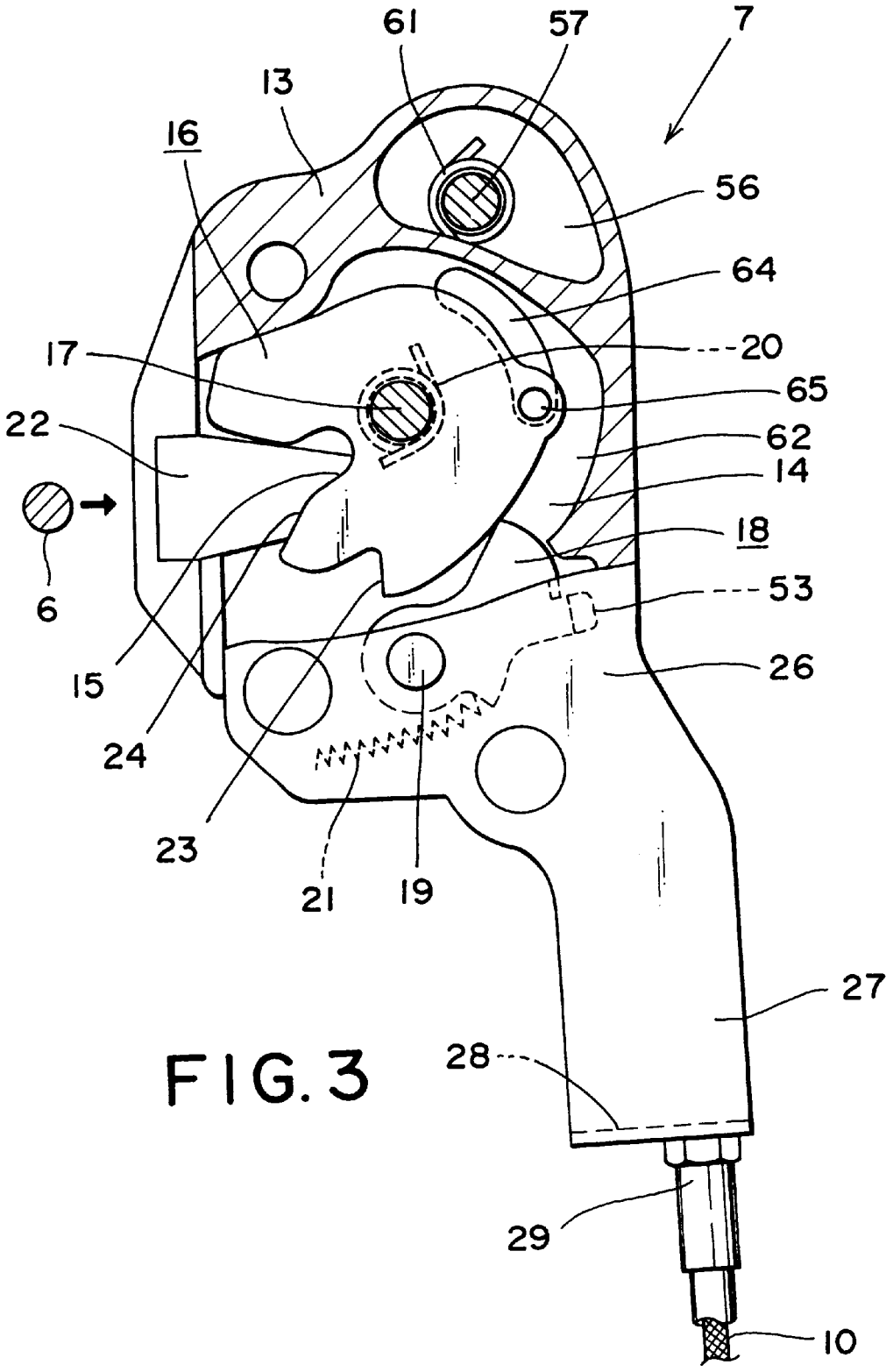
FIG. 3 is a front view of the latch unit.
Figure 4:
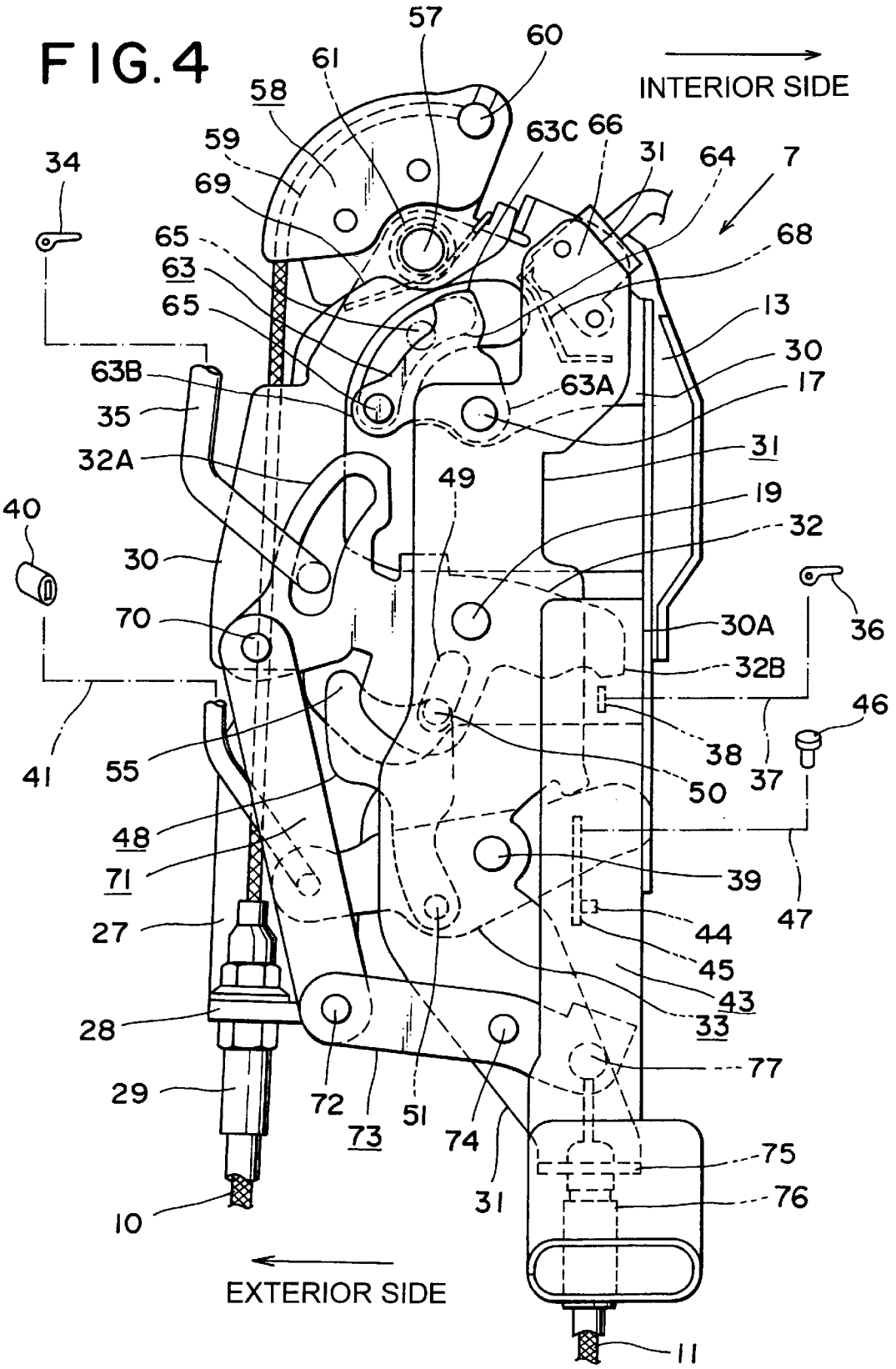
FIG. 4 is a rear view of the latch unit.
Figure 5:
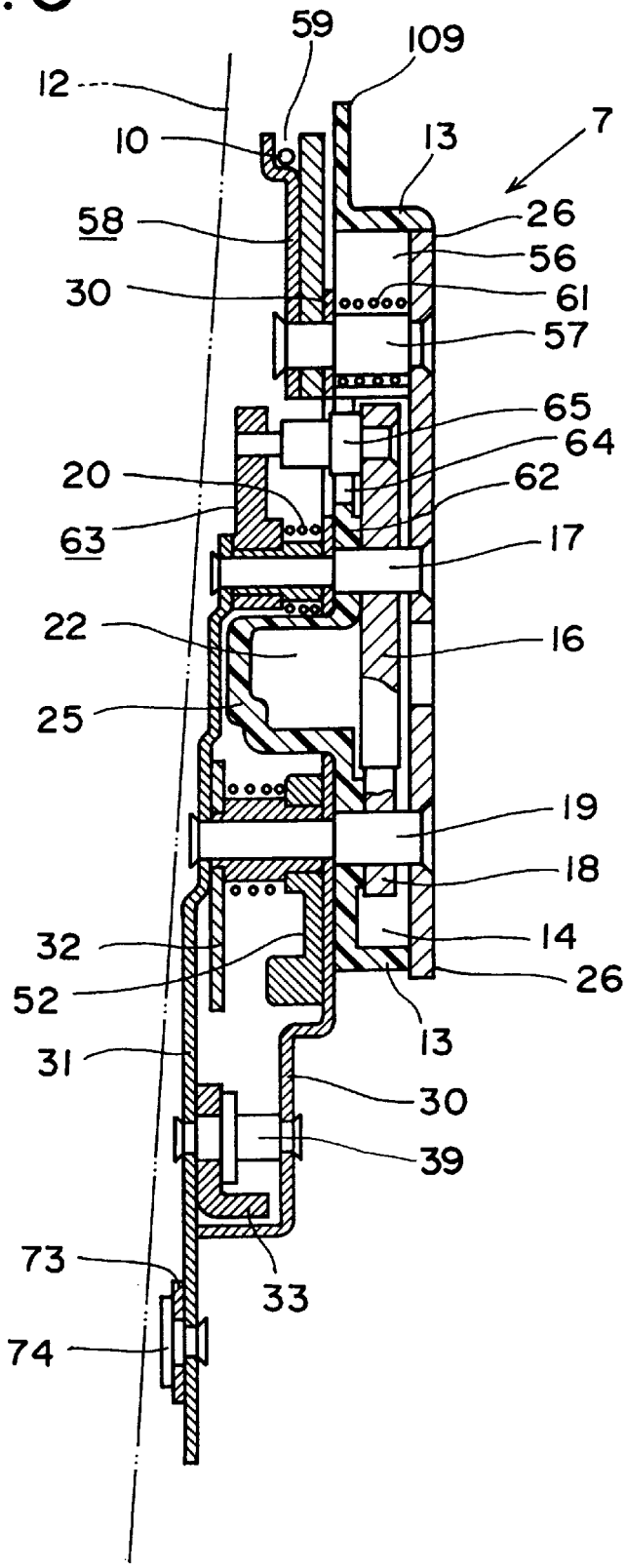
FIG. 5 is a vertically cross sectional side view of the latch unit.
Figure 6:
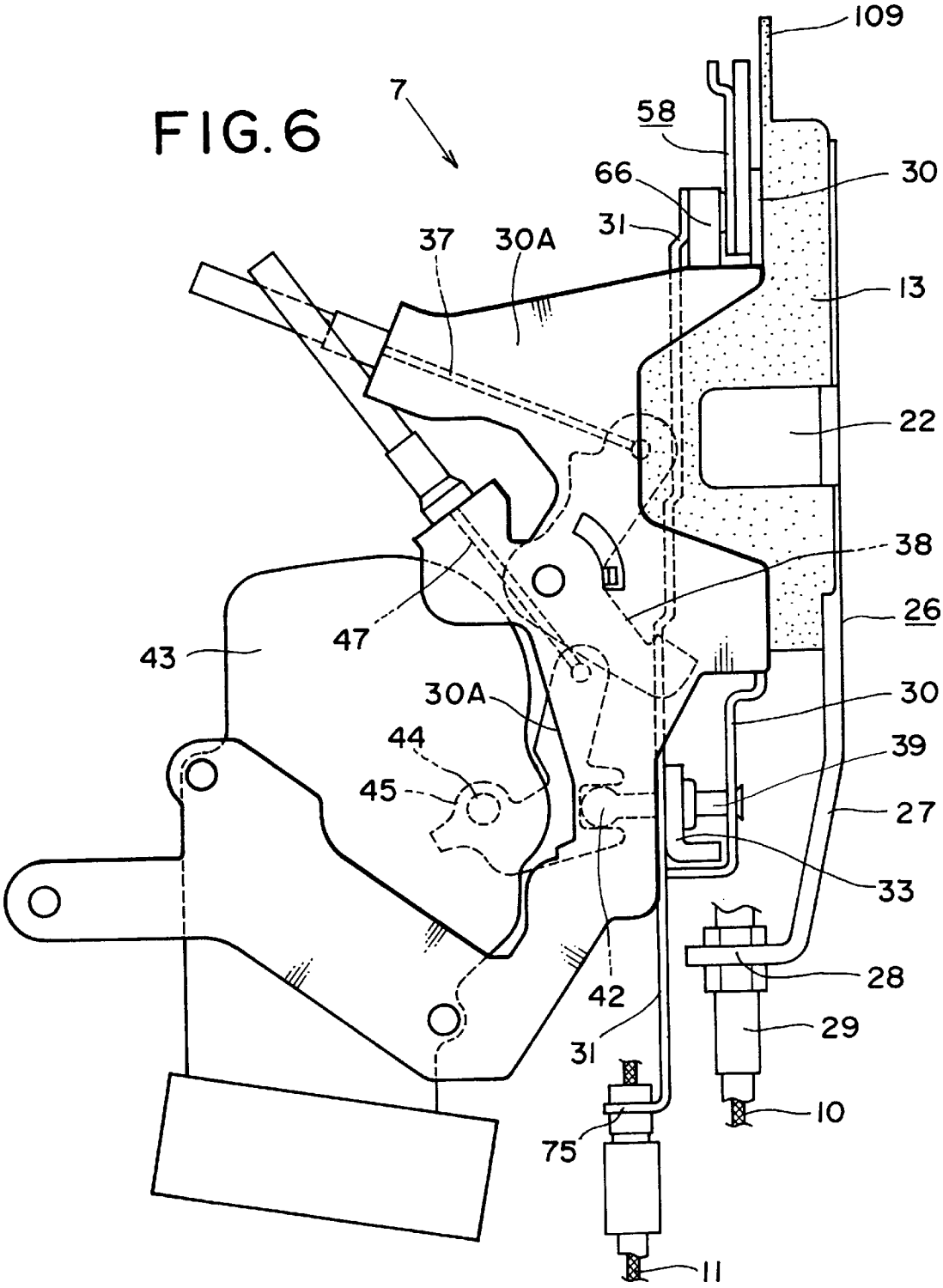
FIG. 6 is a view showing an interior side of the latch unit.

FIG. 3 shows the front side of the latch unit 7. Further, FIG. 4 shows the rear side of the latch unit 7, FIG. 5 shows the vertical cross section thereof, and FIG. 6 shows the left side thereof. It should be noted that the latch unit 7 is attached to the door 2 such that a front surface of the latch unit 7 comes into contact with an inside surface of the rear panel 9, and accordingly, the front surface of the latch unit 7 faces rearward on the basis of the vehicle body. However, in the following description as for the latch unit 7, the words and phrases meaning the direction are used not on the basis of the vehicle body but on the basis of the latch unit itself.

A synthetic resin latch body 13 of the latch unit 7 has a vertically elongated length as best shown in FIGS. 3, 5, and has a wide recess 14 on the front side thereof. A front side of the recess 14 is opened, and a rear side of the recess 14 is closed by a bottom wall 62. A latch 16 and a ratchet 18 are rotatably accommodated in the recess 14 by a latch shaft 17 and a ratchet shaft 19, respectively. In FIG. 3, the latch 16 is urged clockwise by an elasticity of a latch spring 20, and the ratchet 18 is urged counterclockwise by an elasticity of a ratchet spring 21. When moving the door 2 in a door-closing direction, the striker 6 relatively comes into a horizontal passage 22 formed in the latch body 13, and then comes into contact with a U-shaped groove 15 of the latch 16 located in an unlatched position shown in FIG. 3 to turn the latch 16 counterclockwise. As the latch 16 is turned from the unlatched position to a half-latched position due to the contact with the striker 6, the ratchet 18 is engaged with a half-latch step portion 23 of the latch 16, and the door 2 also reaches the half-latched position. Furthermore, when the latch 16 is turned to a full-latched position, the ratchet 18 is engaged with a full-latch step portion 24 of the latch 16, and the door 2 also reaches the full-latched position. 25 is, in FIG. 5, a rearward projecting portion formed in the latch body 13 for defining the horizontal passage 22.

A metal cover plate 26 for closing the recess 14 is fastened to a front surface of the latch body 13. The cover plate 26 has a downward extending arm 27 provided with a bent portion 28, with which a fastener portion 29 of an outer sheath of the power wire 10 is engaged.

Figure 8:
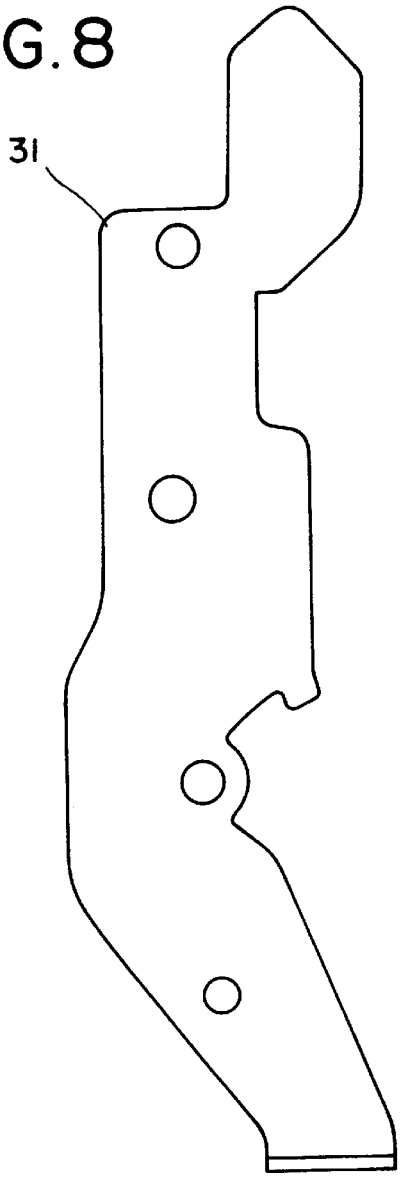
FIG. 8 is a rear view of a metal bracket of the latch unit.
Figure 7:
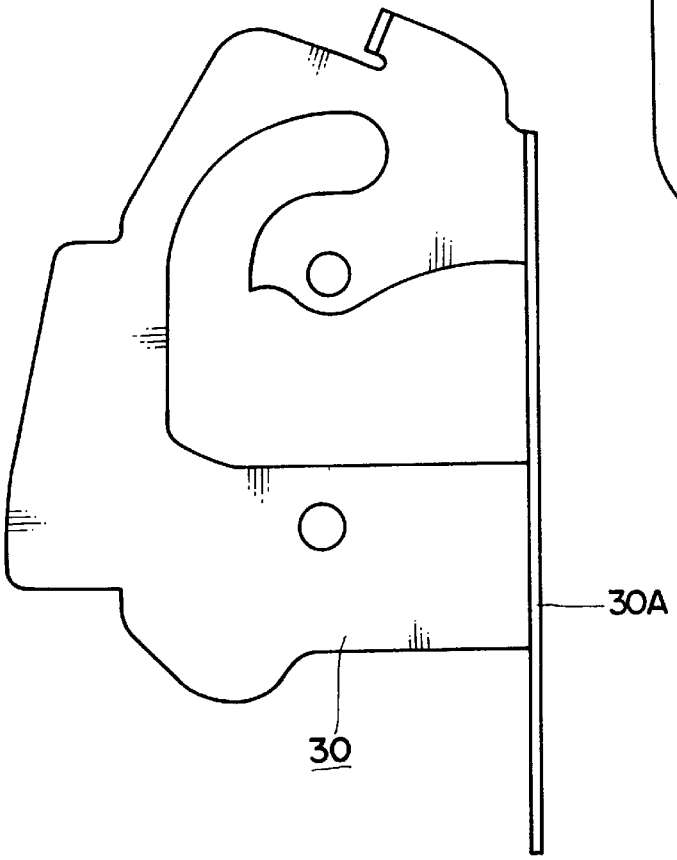
FIG. 7 is a rear view of a metal back plate of the latch unit.

A metal back plate 30 (FIG. 7) is fastened to a rear surface of the latch body 13 with no substantial clearance between the back plate 30 and the latch body 13. The back plate 30 has, on an interior side thereof, a sub plate 30A which is angled to extend in the direction away from the latch body 13. An inner lever 38 which is connected to an inside opening handle 36 of the door 2 through a wire 37, is rotatably attached to the sub plate 30A. A metal bracket 31 (FIG. 8) is attached to the back plate 30, with a clearance between the bracket 31 and the back plate 30.

The latch unit 7 comprises an opening lever 32 for releasing the ratchet 18 from the latch 16, and a lock lever 33 for shifting the latch unit 7 between a locked state and an unlocked state. The opening lever 32 is rotatably attached to the ratchet shaft 19, and the lock lever 33 is pivotally supported at the bracket 31 and/or the back plate 30 with a lock shaft 39.

An exterior arm 32A of the opening lever 32 is connected, with a lost motion, to one end of a rod 35 which is connected to an outside opening handle 34 of the door 2. An exterior portion of the lock lever 33 is connected to a key cylinder 40 of the door 2 through a wire or rod 41. A rearward projecting pin 42 (FIG. 6) is provided at an interior portion of the lock lever 33. The pin 42 is connected to an output lever 45 which is fastened to an output shaft 44 of a motorized actuator 43 which is fixed to the sub plate 30A. The output lever 45 is connected to an inside lock button 46 of the door 2 through a wire 47.

Between the lock lever 33 and the opening lever 32, a lock link 48 is provided. The lock link 48 has a lock pin 50 which is slidably engaged with an elongated hole 49 formed in the opening lever 32, and the lock link is connected to the lock lever 33 with a shaft 51.

Figure 9:
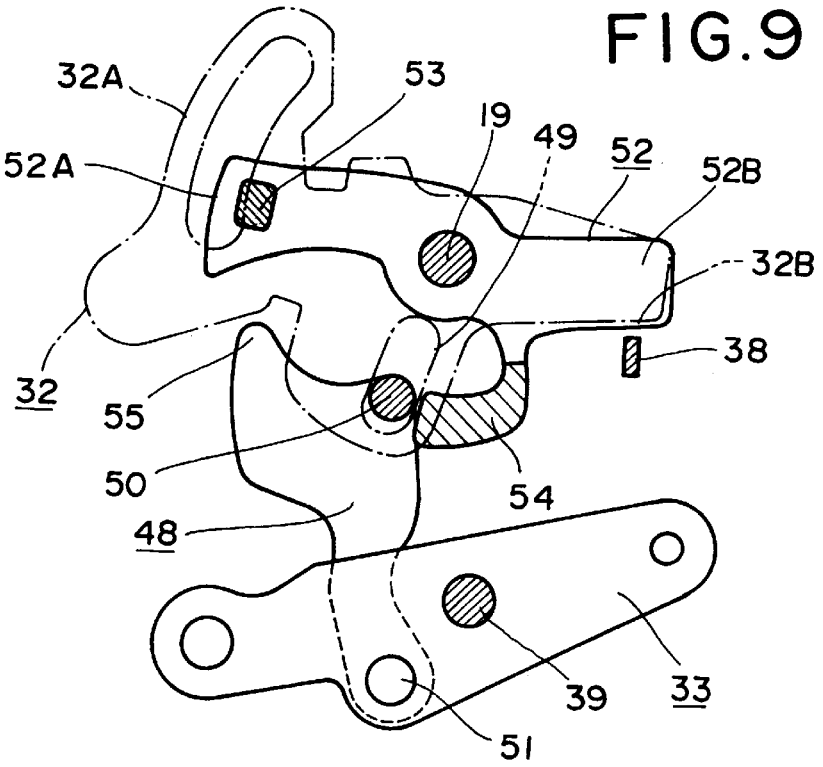
FIG. 9 is an explanation view showing an unlocked state of the latch unit.
Figure 10:
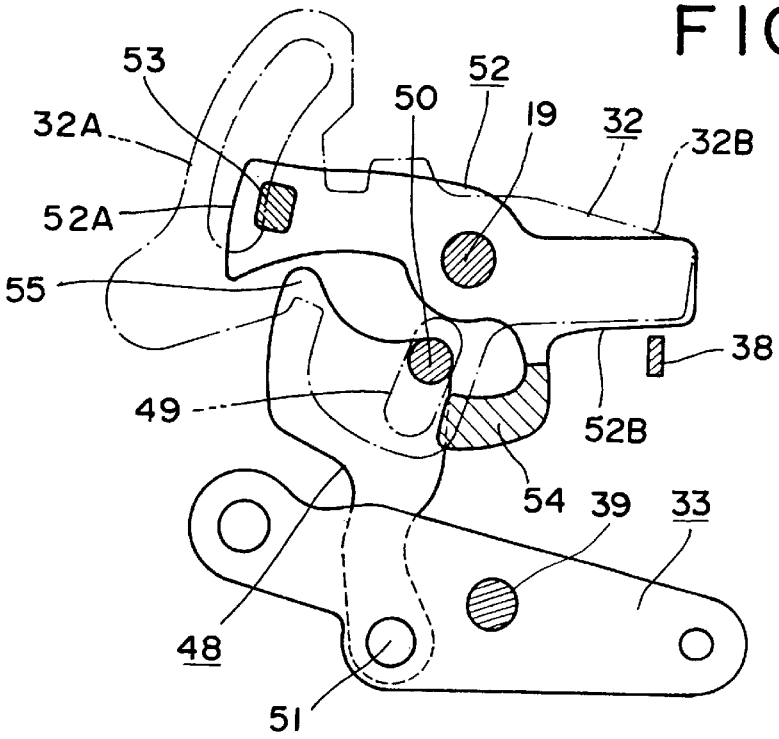
FIG. 10 is an explanation view showing a locked state of the latch unit.

As shown in FIG. 5, a ratchet lever 52 is rotatably mounted on the ratchet shaft 19. A ratchet pin 53 which is projecting from the ratchet 18 toward the rear side of the latch body 13, is engaged with an exterior arm 52A of the ratchet lever 52 as shown in FIGS. 9, 10. An interior arm 52B of the ratchet lever 52 is located on a rotational trail of the inner lever 38, so that the rotational movement of the inner lever 38 by the door-opening operation of the inside opening handle 36 can make the ratchet lever 52 turn counterclockwise in FIG. 9. The counterclockwise rotation of the ratchet lever 52 causes the ratchet 18 to be released from the latch 16 through the ratchet pin 53 so as to open the door 2.

As it is well known, the lock lever 33 shifts the lock link 48 between an unlocked position (FIG. 9) and a locked position (FIG. 10) when the lock lever is turned by the actuation of the key cylinder 40, the actuator 43, or the lock button 46. When the lock link 48 is shifted to the unlocked position, the lock pin 50 is moved to a lower position within the elongated hole 49, and is opposed to a contact arm 54 of the ratchet lever 52 as shown in FIG. 9. In this state, when the opening lever 32 is turned counterclockwise by the door-opening operation of the outside opening handle 34, the lock pin 50 comes into contact with the contact arm 54 to turn the ratchet lever 52 counterclockwise, and thereby the door 2 is opened.

In FIG. 9, when rotating the lock lever 33 clockwise, the lock pin 50 of the lock link 48 is moved upward and is shifted to the locked position, as shown in FIG. 10. In the state of FIG. 10, the counterclockwise rotation of the opening lever 32 cannot turn the ratchet arm 52 and open the door 2 because the lock pin 50 is separated from the contact arm 54. However, even in the state of FIG. 10, the rotation of the inner lever 38 by the door-opening operation of the inside opening handle 36 can be transmitted to the ratchet lever 52, as mentioned above, and accordingly, it can open the door 2. In this way, the door-opening operation of the inside opening handle 36 is effective, even if the lock pin 50 is in the locked position.

The lock link 48 has a nose portion 55 extending toward the exterior arm 52A of the ratchet lever 52. The nose portion 55 is arranged on the same flat surface as the exterior arm 52A. In the unlocked state of FIG. 9, a wide clearance is formed between the nose portion 55 and the under surface of the exterior arm 52A, so that the exterior arm 52A cannot come into contact with the nose portion 55 when the ratchet lever 52 is turned counterclockwise by the door-opening operation of either of the opening handles 34, 36. However, in the locked state of FIG. 10, the clearance between the nose portion 55 and the exterior arm 52A becomes narrower. Therefore, when the ratchet lever 52 is turned counterclockwise by the door-opening operation of the inside opening handle 36, the exterior arm 52A comes into contact with the nose portion 55, and moves downward the lock link 48, and restores the lock pin 50 to the unlocked position. Accordingly, the door-opening operation of the inside opening handle 36 in the locked state, simultaneously performs the opening of the door 2 and the restoring of the lock pin 50 to the unlocked position. This mechanism is called "one-motion door opening mechanism" of the inside opening handle 36.

An interior arm 32B of the opening lever 32 is positioned on the rotational trail of the inner lever 38, similarly to the interior arm 52 B of the ratchet lever 52, so that the rotational movement of the inner lever 38 by the door-opening operation of the inside opening handle 36 can make the opening lever 32 turn counterclockwise in FIG. 9. The arrangement where both interior arms 32B, 52B of the opening lever 32 and the ratchet lever 52 can come into contact with the inner lever 38, is one of the features of the present invention. This arrangement, to be described later, is used for actuating a safety mechanism of the powered closing unit 8.

As shown in FIGS. 3 and 5, in the upper portion of the latch body 13 is formed an upper space or hole 56 which is not communicated with the recess 14. Both front and rear sides of the space 56 are opened to the outside. A wire shaft 57 which is supported by the cover plate 26 and the back plate 30, is contained in the space 56. A wire lever 58 is rotatably mounted on the rear end of the wire shaft 57. As shown in FIG. 5, the wire lever 58 is positioned behind the back plate 30, but between the wire lever 58 and the latch body 13, no substantial clearance is formed. The wire lever 58 is formed from two pieces of metal sector plates, and has, at the peripheral fringe thereof, a wire groove 59 to which the power wire 10 is fitted. A cable end 60 of the power wire 10 is connected to the wire lever 58. Onto the periphery of the wire shaft 57 between the cover plate 26 and the back plate 30, a coil portion of a torsion coil spring 61 is attached. One leg portion of the spring 61 is brought into contact with the latch body 13, and the other leg portion is engaged with to the wire lever 58 so as to urge the wire lever 58 clockwise in FIG. 4. The wire lever 58 turns counterclockwise in FIG. 4 when the powered closing unit 8 pulls the power wire 10, and the wire lever is restored to an initial position shown in FIG. 4 by the elasticity of the spring 61 when the closing unit 8 releases the power wire 10.

As shown in FIG. 5, the rear end of the latch shaft 17 is extending rearward to be fixed to the bracket 31, penetrating the bottom wall 62 of the latch body 13 and the back plate 30. To the latch shaft 17 between the back plate 30 and the bracket 31, a base portion 63A of a switch lever 63 is rotatably attached. The switch lever 63 has a triangle shape, and one end 63B thereof is connected to a latch pin 65 projecting rearward through a circular arc slot 64 of the latch body 13 from the latch 16, so that the switch lever 63 is rotated together with the latch 16 as one piece. The latch spring 20 is provided between the back plate 30 and the bracket 31, and urges the latch 16 clockwise in FIG. 3 by urging the switch lever 63 counterclockwise in FIG. 4.

At the upper portion on the rear side of the latch body 13, a switch 66 is provided for detecting the unlatched position, half-latched position, and full-latched position of the latch 16. The switch 66 is turned on due to the contact between an arm 68 thereof and the other end 63C of the switch lever 63. When the latch 16 is displaced from the unlatched position to the half-latched position by the engagement with the striker 6, the latch pin 65 is shifted, in FIG. 4, from the position shown by the solid line to the position shown by the dotted line, thereby the switch lever 63 is also shifted from the unlatched position to the half-latched position, whereby the end portion 63C of the switch lever 63 comes into contact with the switch arm 68 to turn on the switch 66. The end portion 63C is separated from the switch arm 68 to turn off the switch 66 when the latch 16 is rotated a little beyond the full-latched position. The position of the latch 16 is detected by the signal from the switch 66. The powered closing unit 8 starts the operation to pull the power wire 10 when the switch 66 is turned on, and the powered closing unit releases the power wire 10 and returns to the standby state when the switch 66 is turned off. By the way, the signal from the switch 66 can be also used for the control of an interior light or the like of the vehicle.

Figure 11:
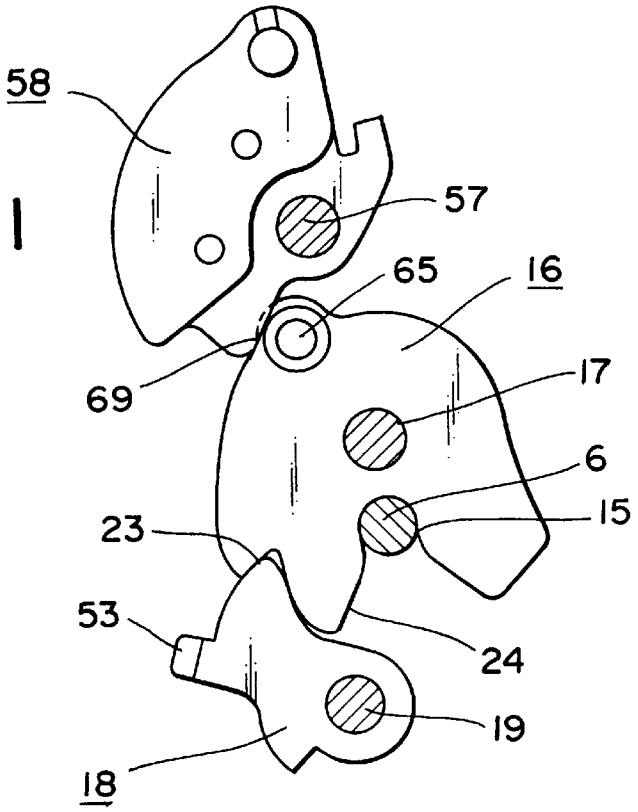
FIG. 11 is an explanation view showing a half-latched position of a latch of the latch unit.
Figure 12:
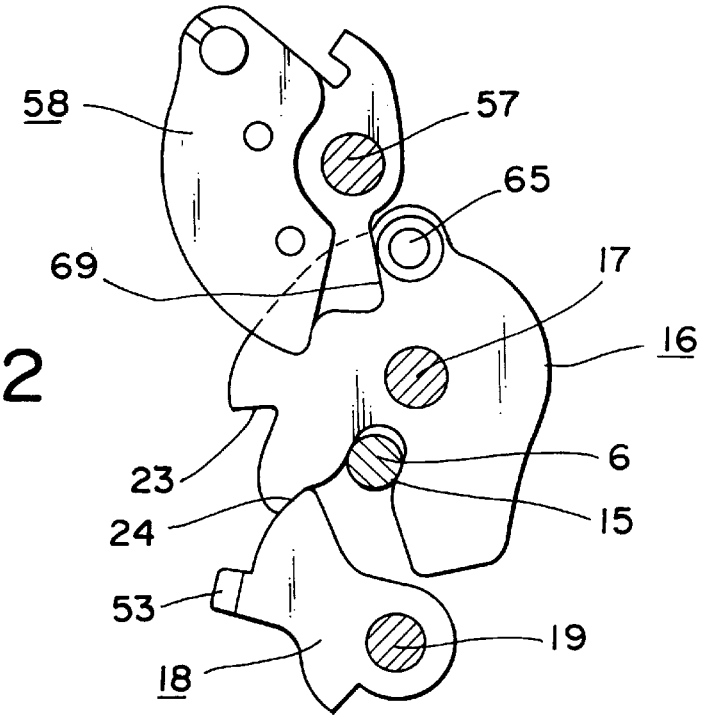
FIG. 12 is an explanation view showing a full-latched position of the latch of the latch unit.
Figure 13:
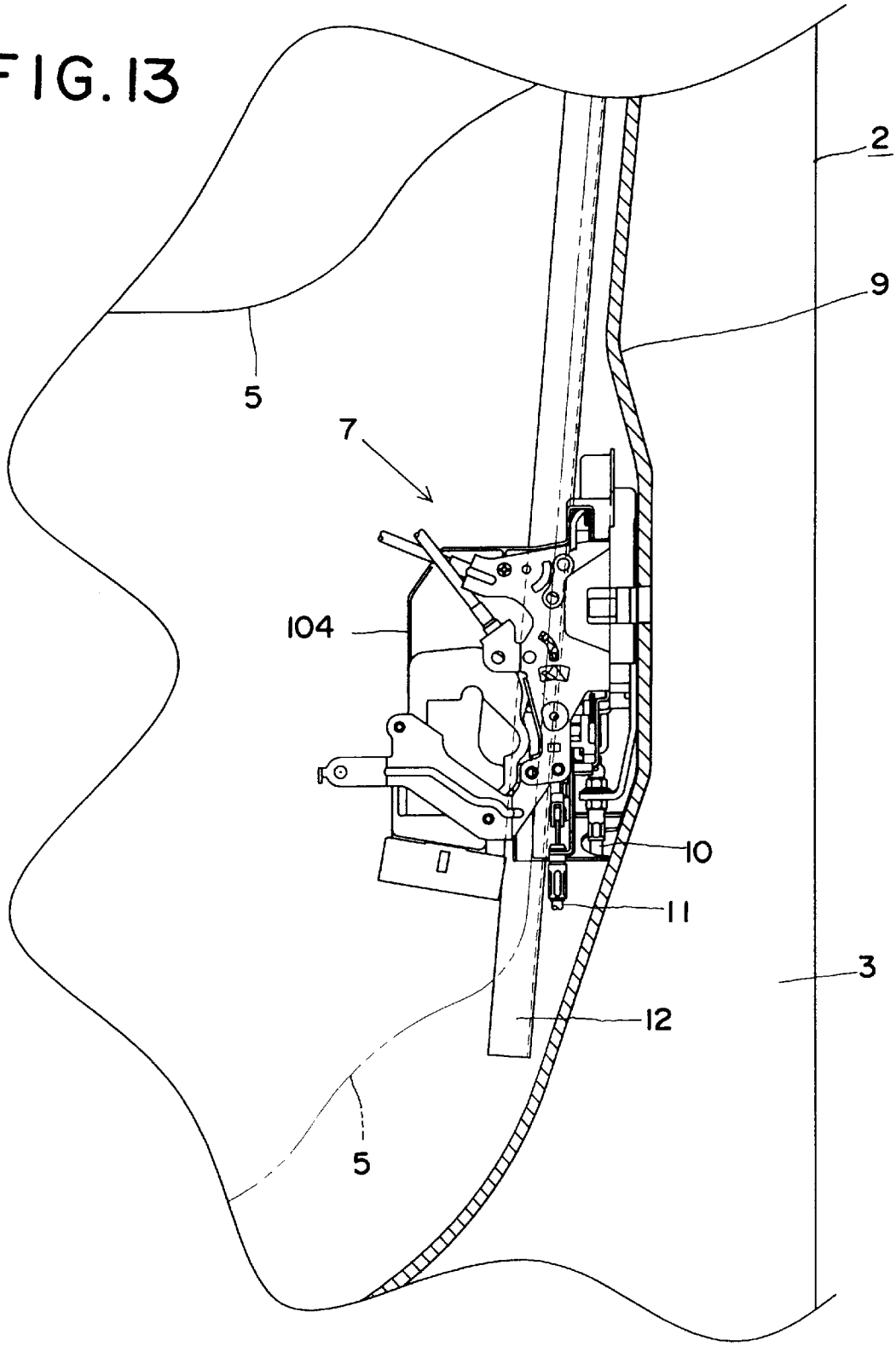
FIG. 13 is a schematic view showing the relation between the latch unit and the glass rail.

When the power wire 10 is pulled by the powered closing unit 8 activated by the turn on of the switch 66, the wire lever 58 is turned counterclockwise in FIG. 4 against the elasticity of the return spring 61, and a press surface 69 of the wire lever 58 is then brought into contact with the latch pin 65 located in the half-latched position shown by the dotted line, and thereby the latch 16 is turned from the half-latched position to a excessively turned position, passing the full-latched position (refer to FIGS. 11, 12). Accordingly, even if the manual power to close the door 2 is insufficient for displacing the door 2 into the full-latched position, the door 2 can be fully closed by the assist of the closing unit 8, if the manual power is sufficient for displacing the door 2 into the half-latched position.

As shown in FIG. 2, the glass rails 12 is opposed to the approximately middle position between the interior side and the exterior side of the latch unit 7 attached to the door 2. Therefore, in FIG. 4, it is required to reduce the thickness of the latch unit 7 on the line connecting the latch shaft 17 and the ratchet shaft 19, and especially, it is required to reduce the thickness of the upper central part of the latch unit 7, because of the inclination of the glass rail 12 shown in FIG. 5. The latch unit 7 of the present invention is designed so that the thickness of the upper central part thereof may be reduced. A first feature of the design is in such a point that the spring 61 for restoring the wire lever 58 to the initial position is contained in the space 56. Since the space 56 is formed in the latch body 13, the attachment of the return spring 61 does not increase the thickness of the latch unit 7. A second feature is in such a point that the thickness itself of the latch body 13 of the present invention is reduced. Although the depth of the recess 14 of the latch body 13 for containing the latch 16 and the ratchet 18 is equal to that of a conventional one, the thickness of the bottom wall 62 of the recess 14 is reduced when compared with that of a conventional one. This is made because the bottom wall 62 has no space for containing the latch spring 20. A third feature is in such a point that the switch 66 is attached on the side of the latch body 13 so as not to be overlapped onto the glass rail 12 in the front-and-rear direction of the latch unit 7. A fourth feature is in such a point that the switch 66 is attached to such a position as not to be overlapped onto the rotational trail of the wire lever 58 in the front-and-rear direction. Since the switch 66 does not interfere with the rotation of the wire lever 58, the space for containing the switch 66 is not required between the latch body 13 and the wire lever 58.

In FIG. 4, an upper end of a safety link 71 is pivotally connected to the exterior arm 32A of the opening lever 32 with a pin 70, and a lower end of the safety link 71 is pivotally connected to one end of a safety lever 73 with a shaft 72. The safety lever 73 is pivoted at the metal bracket 31 with a shaft 74. A fastener portion 76 of the outer sheath of the safety wire 11 is engaged with a lower end bent portion 75 of the bracket 31, and a cable end 77 of the safety wire 11 is engaged with the other end of the safety lever 73. According to this arrangement, when the opening lever 32 is rotated by the operation of either the outside opening handle 34 or the inside opening handle 36, the safety wire 11 is pulled through the safety link 71 and the safety lever 73, and thereby the safety mechanism of the powered closing unit 8, to be described later, is operated to set the power wire 10 free. The interior arm 32B of the opening lever 32 is arranged such that it can be engaged with the inner lever 38, for the purpose of making it possible to turn the opening lever 32 by the inside opening handle 36.

Next, the structure of the powered closing unit 8 will be described by using FIGS. 14 to 18. A base plate 78 of the powered closing unit 8 is fixed to the door 2 at a position below the lower limit position of the window glass 5 in the inside space of the door 2. An approximately fan-shaped output member 79 is rotatably attached to the base plate 78 with a support shaft 80. The output member 79 has a gear portion 83 with which a motor gear 82 of a motor 81 is meshed. A winch lever 84 (FIG. 17) is rotatably attached to the support shaft 80 so as to be overlapped with the output member 79. One end side of the winch lever 84 is formed into a fan shape around the support shaft 80 as a center, and the winch lever has, on the peripheral fringe thereof, a wire groove 85 with which the power wire 10 is engaged.

A connecting member 87 (FIG. 18) is provided between the winch lever 84 and the output member 79 and has a slot 86 into which the support shaft 80 is inserted. The connecting member 87 is provided with a connecting pin 88 at the tip end thereof which projects from opposite sides of the connecting member 87. The output member 79 has a U-shaped engaging groove 89 which is engageable with one end of the connecting pin 88, and the winch lever 84 has at the other end thereof a slot 90 with which the other end of the connecting pin 88 is engaged. Between a projection 91 of the connecting member 87 and a projection 92 of the winch lever 84 is provided a connecting spring 93 which holds the engagement between the connecting pin 88 of the connecting member 87 and the engaging groove 89 of the output member 79. The winch lever 84 is urged counterclockwise in FIG. 14 through the power wire 10 by the elasticity of the spring 61 which restores the wire lever 58 to the initial position.

Figure 14:
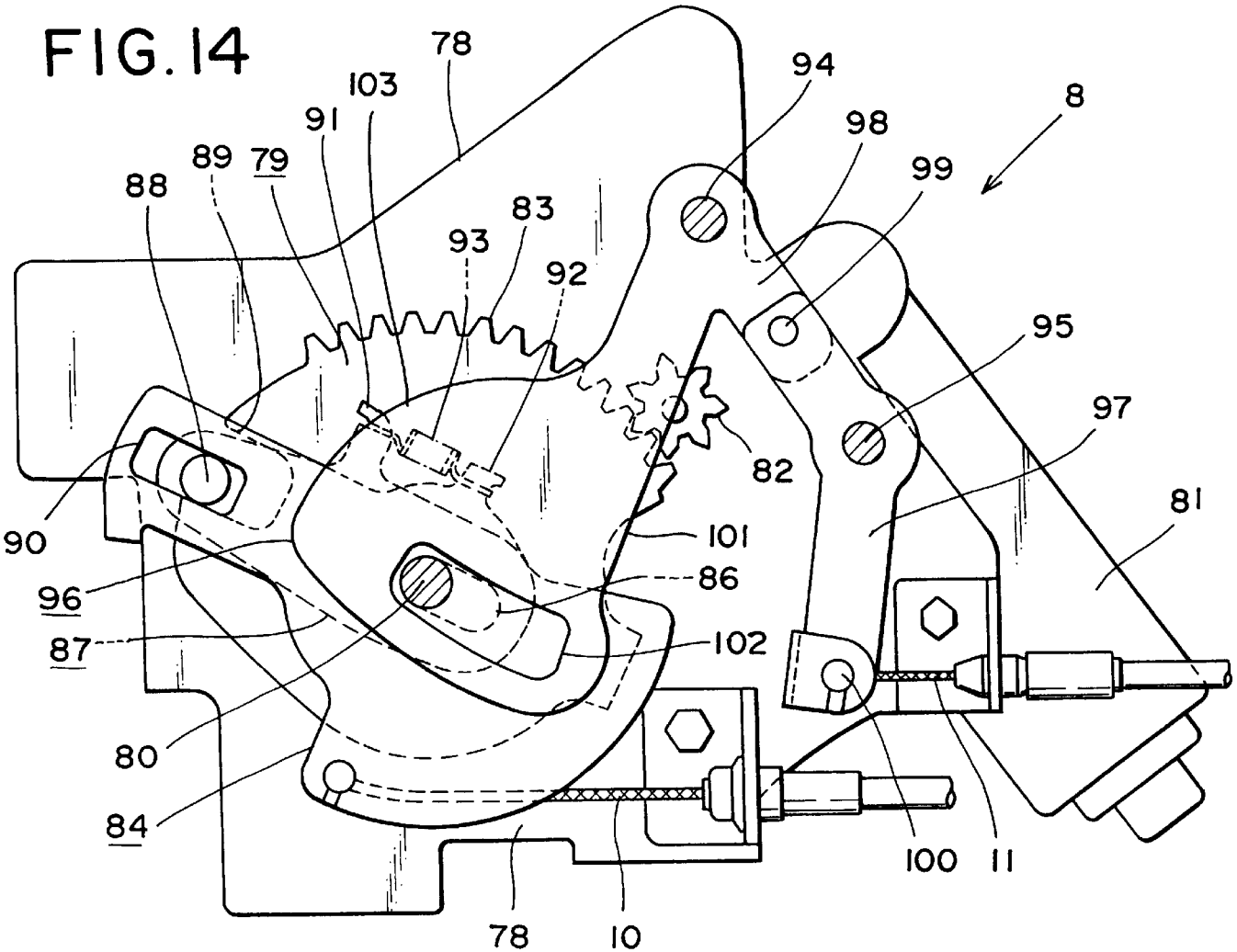
FIG. 14 is a front view of a powered closing unit of the door latch device.

The output member 79 is in the position shown in FIG. 14 when the powered closing unit is in the waiting state. In this state, when the switch 66 detects the displacement of the latch 16 from the unlatched position to the half-latched position, the motor 81 causes the output member 79 to turn clockwise, and the connecting member 87 is then rotated clockwise by the engagement between the engaging groove 89 of the output member 79 and the connecting pin 88 of the connecting member 87, and thereby the winch lever 84 is rotated clockwise by the engagement between the connecting pin 88 and the slot 90 of the winch lever 84. Then, the power wire 10 is pulled, and the wire lever 58 of the latch unit 7 is rotated counterclockwise in FIG. 4, and, as mentioned above, the press surface 69 of the wire lever 58 is brought into contact with the latch pin 65 to displace the latch 16 into the full-latched position, thereby the door 2 is fully closed.

The powered closing unit 8 has a canceling lever 96 and an intermediate lever 97 which are pivoted to the base plate 78 with shafts 94, 95. A first arm 98 of the canceling lever 96 is connected to the intermediate lever 97 with a pin 99, and the intermediate lever 97 is connected to a cable end 100 of the safety wire 11. Therefore, the canceling lever 96 is rotated clockwise around the shaft 94 as a center through the safety wire 11 when the opening lever 32 is turned by the door-opening operation of the outside opening handle 34 or the inside opening handle 36.

Figure 15:
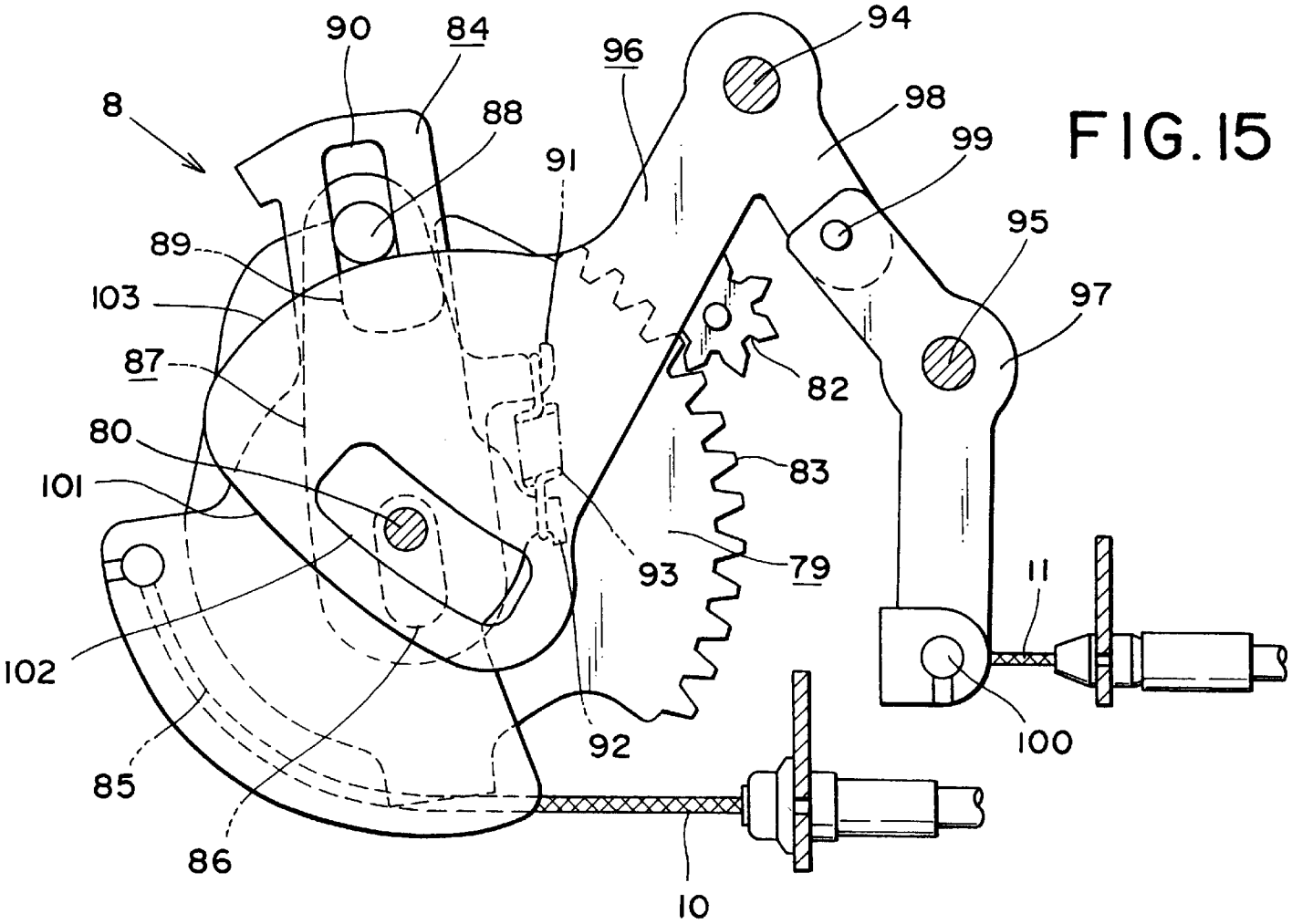
FIG. 15 is a front view showing an active state of the powered closing unit.

A second arm 101 of the canceling lever 96 is arranged so as to be overlapped with the output member 79, and has a circular arc slot 102 around the shaft 94 as a center. The support shaft 80 is inserted into the circular arc slot 102 so that the rotational range of the canceling lever 96 is defined by a gap between the slot 102 and the support shaft 80. When the opening handles 34, 36 are not operated, the second arm 101 is in the position shown in FIG. 14 and is substantially overlapped with the output member 79 except at its base portion near the shaft 94. A circular arc-shaped canceling cam face 103 is formed at the side of the second arm 101. The canceling cam face 103 is moved in the direction of away from the support shaft 80 when the safety wire 11 is pulled by the rotation of the opening lever 32. Therefore, when the door-opening operation of either the outside opening handle 34 or the inside opening handle 36 is performed while the output member 79 is rotated by the motor 81, the canceling cam face 103 comes into contact with the connecting pin 88 of the connecting member 87 as shown in FIG. 15 so as to slide the connecting member 87 against the elasticity of the spring 93. Thereby the connecting pin 88 is separated from the engaging groove 89 of the output member 79, and the connection between the output member 79 and the connecting member 87 is released. This means that the power transmission of the powered closing unit 8 is interrupted, and the rotation of the latch 16 in the full-latch direction is stopped.

As mentioned above, in the latch device 1 of the present invention, the latch unit 7 and the powered closing unit 8 can be connected by two flexible wires 10, 11, and therefore, the installation position of the powered closing unit 8 can freely be set. Furthermore, the wires 10, 11 can be arranged approximately in parallel with each other, and therefore, the overcrowding of a lot of connecting means in the inside space of the door 2 can be prevented.

Figure 19:
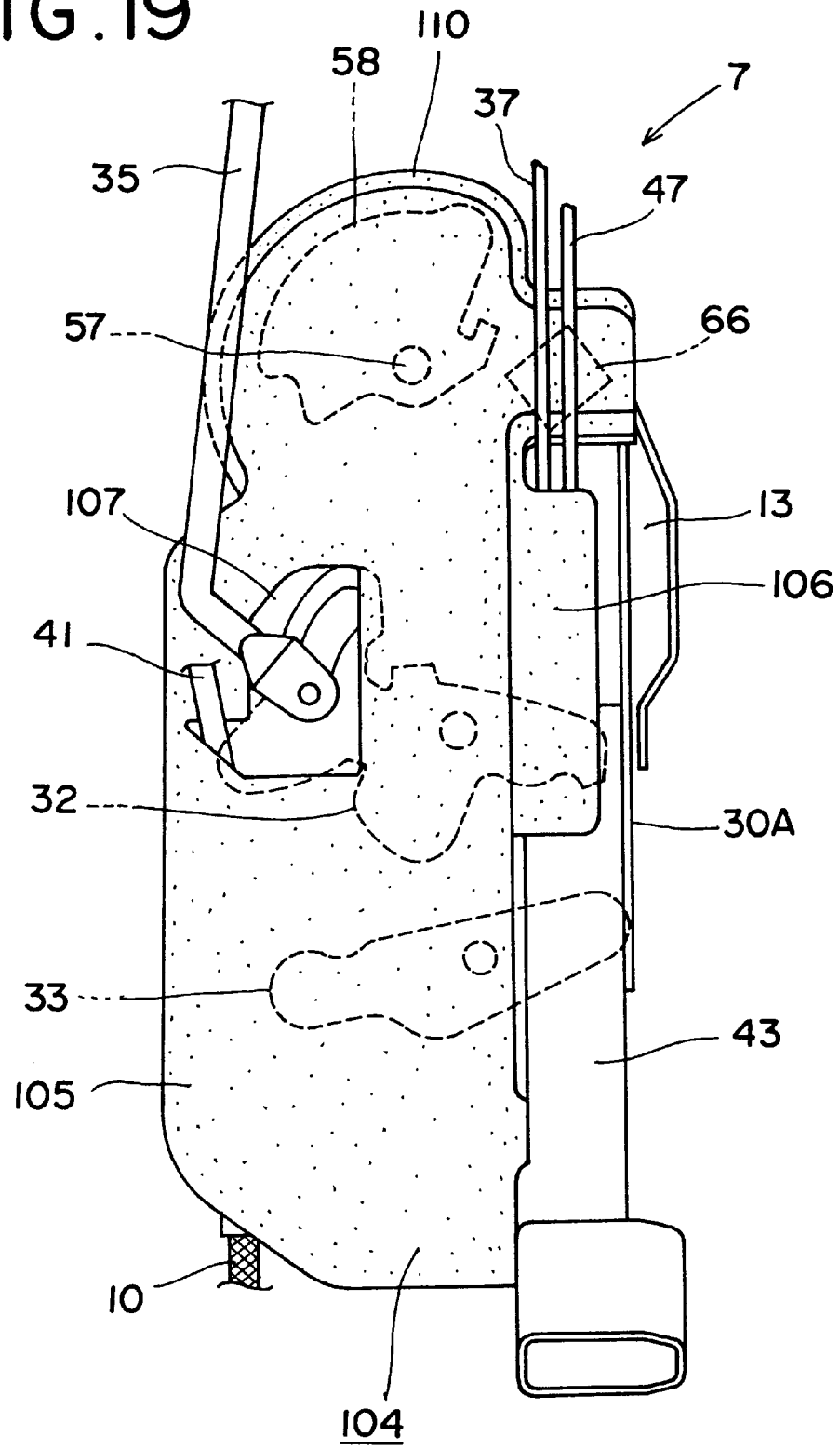
FIG. 19 is a rear view of the latch unit provided with an antitheft protector.

As shown in FIGS. 19, 20, a resin antitheft protector 104 is attached on the rear side of the latch unit 7. The protector 104 comprises a main case 105 which surrounds the rear side of the latch body 13 and a sub case 106 which surrounds the angled sub plate 30A of the back plate 30. By the main case 105, the parts arranged on the rear side of the latch body 13 such as the wire lever 58, the opening lever 32, the lock lever 33, or the switch 66 are protected from unauthorized accesses, and by the sub case 106, the inner lever 38 attached to the sub plate 30A, the output lever 45 of the actuator 43, and the like are protected from unauthorized accesses. The main case 105 has an opening portion 107 which is the passage of the rod 35 leading to the outside opening handle 34 and the rod 41 leading to the key cylinder 40.

An upper ceiling portion 110 of the main case 105 horizontally extends from a substantial vertical portion 113 of the main case 105 toward the latch body 13 so that it is overlapped with an upper portion 111 of the latch body 13 in the up-and-down direction. The rain water which enters into the inside space of the door 2 is prevented from falling on the wire lever 58, the switch 66, or the like. In this way, the protector 104 of the present invention serves for both two functions of antitheft function and waterproofing.

As shown in FIGS. 5, 21, the waterproof effect by the antitheft protector 104 can easily be improved by sealing the clearance between a collar portion 109 formed to the upper portion 111 of the latch body 13 and the ceiling portion 110 of the protector 104 with a sealing member 108. Furthermore, as shown in FIG. 22, the ceiling portion 110 of the antitheft protector 104 can be integrally formed with a groove portion 112 to be engaged with the collar portion 109.

What is claimed is:

1. A vehicle door latch device in combination with a swing type vehicle door, comprising:

a latch unit fixed a rear end portion of the door, said latch unit having a latch which is rotatably from an unlatched position through a half-latched position to a full-latched position by an engagement with a striker adapted to be fixed to a vehicle body, and an opening lever which is connected to an opening handle of the door and releases the engagement between the latch and the striker;

a powered closing unit provided in an inside space of the door and rotating the latch from the half-latched position to the full-latched position, said powered closing unit having a motor, a winch lever which is operatively connected to the latch through a flexible power wire and is rotated by the motor, and a canceling lever for releasing a connection between the winch lever and the motor; and wherein said opening lever and said canceling lever are connected by a flexible safety wire approximately in parallel with said power wire.

2. A vehicle door latch device comprising:

a latch rotatable from an unlatched position through a half-latched position to a full-latched position by an engagement with a striker fixed to a vehicle body;

a ratchet preventing the latch from returning from the half-latched position or the full-latched position to the unlatched position, by an engagement with the latch;

an opening lever adapted to be connected to an outside opening handle of a vehicle door;

a lock mechanism having an unlocked state where a rotation of the opening lever is transmitted to the ratchet and a locked state where the rotation of the opening lever is not transmitted to the ratchet;

an inner lever adapted to be connected to an inside opening handle of the vehicle door, said inner lever being able to come into contact with the ratchet so that a rotation of the inner lever can be transmitted to the ratchet without involving the lock mechanism;

said lock mechanism being arranged so as to be restored to the unlocked state when the inner lever is turned while the lock mechanism is in the locked state;

a powered closing unit for rotating the latch from the half-latched position to the full-latched position, said powered closing unit having a motor, a winch lever which is operatively connected to the latch through a wire and is rotated by the motor, and a canceling lever for releasing a connection between the winch lever and the motor; and wherein said canceling lever is connected to the opening lever;

wherein an interior arm of the opening lever is positioned on a rotational trail of the inner lever so that the opening lever is turned by a rotation of the inner lever.

3. The vehicle door latch device according to claim 2, further comprising a ratchet lever rotated together with the ratchet as one piece, said ratchet lever having an interior arm which is positioned on a rotational trail of the inner lever and is substantially overlapped with the interior arm of the opening lever.

4. The vehicle door latch device according to claim 3, wherein said ratchet lever has an exterior arm which restores the lock mechanism from the locked state to the unlocked state.

5. A vehicle door latch device in combination with a swing type vehicle door, comprising:

a latch body fixed a rear end portion of the door and having a recess at a front side thereof;

a latch rotatably contained in the recess with a latch shaft having a shaft center in a given direction, said latch being rotatable from an unlatched position through a half-latched position to a full-latched position by an engagement with a striker adapted to be fixed to a vehicle body;

a latch spring urging the latch from the full-latched position toward the unlatched position;

a ratchet rotatably contained in the recess with a ratchet shaft in parallel with the latch shaft, said ratchet preventing the latch from returning from the half-latched position or the full-latched position to the unlatched position, by an engagement with the latch;

a switch attached to the latch body for detecting a rotational position of the latch;

a wire lever rotatably attached to the latch body with a wire shaft in parallel with the latch shaft, said wire lever causing the latch to turn from the half-latched position to the full-latched position when rotated;

a return spring urging the wire lever toward an initial position, said return spring having a coil portion and a pair of leg portions;

a powered closing unit provided in an inside space of the door and rotating the wire lever against an elasticity of the return spring when the switch detects the half-latched position of the latch;

wherein said latch spring is provided on a rear side of the latch body, and said wire lever is provided at an upper portion of the rear side of the latch body, and said coil portion of the return spring is provided within the latch body, and said switch is attached to the latch body in such a position as not to be overlapped with the wire lever and a rotational range of the wire lever in the given direction.

6. The vehicle door latch device according to claim 5, wherein said door includes a glass rail which slidably holds a window glass of the door, and said switch is not overlapped with the glass rail in the given direction.

7. The vehicle door latch device according to claim 5, wherein said coil portion of the return spring is arranged around the wire shaft.

8. The vehicle door latch device according to claim 5, wherein said latch shaft comprises an extension shaft positioned on the rear side of the latch body, and said coil portion of the latch spring is arranged around the extension shaft.

9. The vehicle door latch device according to claim 8, further comprising a switch lever rotated together with the latch as one piece and being able to come into contact with a switch arm of the switch, wherein said switch lever is rotatably attached to the extension shaft, and said elasticity of the latch spring is transmitted to the latch through the switch lever.

10. A vehicle door latch apparatus comprising:

a latch engageable with a striker adapted to be fixed to a vehicle body;

a ratchet holding an engagement between the latch and the striker by an engagement with the latch;

a switch detecting a rotational position of the latch;

an opening lever adapted to be connected to an outside opening handle of the vehicle door;

a lock lever having an unlocked position where a rotation of the opening lever is transmitted to the ratchet and a locked position where the rotation of the opening lever is not transmitted to the ratchet;

a latch body adapted to be fixed to the vehicle door and having on a front side thereof a recess for containing the latch and the ratchet;

said opening lever, said lock lever and said switch being provided on a rear side of the-latch body; and a synthetic resin antitheft protector covering the opening lever, the lock lever, and the switch and interrupting an unauthorized access thereto;

wherein said antitheft protector has an upper ceiling portion which is overlapped with an upper portion of the latch body in an up-and-down direction of the latch body; and further comprising a metal back plate which is attached to a rear surface of the latch body and includes an angled sub plate extending in a direction away from the latch body, and an inner lever which is rotatably attached to the sub plate and is adapted to be connected to an inside opening handle of the vehicle door, wherein said antitheft protector includes a main case which covers the opening lever, the lock lever, and the switch, and a sub case which is integrally formed with the main case and covers the inner lever, and the switch, and a sub case which is integrally formed with the main case and covers the inner lever.

* * * * *